US010056738B2

(12) United States Patent
Burrows et al.

(10) Patent No.: US 10,056,738 B2
(45) Date of Patent: Aug. 21, 2018

(54) CORONA IGNITION DEVICE WITH IMPROVED ELECTRICAL PERFORMANCE

(71) Applicant: Federal-Mogul Ignition Company, Southfield, MI (US)

(72) Inventors: John Antony Burrows, Chesire (GB); John E. Miller, Temperance, MI (US); Kristapher I. Mixell, Plymouth, MI (US); James D. Lykowski, Temperance, MI (US)

(73) Assignee: Federal-Mogul LLC, Southfield, MI (US)

( * ) Notice: Subject to any disclaimer, the term of this patent is extended or adjusted under 35 U.S.C. 154(b) by 13 days.

(21) Appl. No.: 15/240,652

(22) Filed: Aug. 18, 2016

(65) Prior Publication Data

US 2016/0359302 A1 Dec. 8, 2016

Related U.S. Application Data

(63) Continuation-in-part of application No. 14/742,064, filed on Jun. 17, 2015, now Pat. No. 9,970,408, which (Continued)

(51) Int. Cl.
*H01T 13/50* (2006.01)
*H01T 19/00* (2006.01)

(Continued)

(52) U.S. Cl.
CPC ..... *H01T 13/50* (2013.01); *F02P 3/01* (2013.01); *F02P 23/04* (2013.01); *F02P 23/045* (2013.01);

(Continued)

(58) Field of Classification Search
CPC ..... H01T 19/00; H01T 13/50; H01T 19/02; H01T 19/04

(Continued)

(56) References Cited

U.S. PATENT DOCUMENTS 1,958,580 A * 5/1934 Kasarjian ..... H01T 13/38
123/169 DW
2,356,102 A * 8/1944 Tognola ..... H01T 13/467
174/152 S (Continued)

FOREIGN PATENT DOCUMENTS

DE 102014111897 A1 4/2015
DE 102014111684 B3 10/2015

(Continued)

OTHER PUBLICATIONS

International Search Report, dated Nov. 23, 2016 (PCT/US2016/047678).

(Continued)

*Primary Examiner* — Stephen K Cronin
*Assistant Examiner* — Susan Scharpf
(74) *Attorney, Agent, or Firm* — Robert L. Stearns; Dickinson Wright, PLLC

(57) ABSTRACT

A corona comprises a central electrode surrounded by an insulator, which is surrounded by a conductive component. The conductive component includes a shell and an intermediate part both formed of an electrically conductive material. The intermediate part is a layer of metal which brazes the insulator to the shell. An outer surface of the insulator presents a lower ledge, and the layer of metal can be applied to the insulator above the lower ledge prior to or after inserting the insulator into the shell. The conductive inner diameter is less than an insulator outer diameter directly below the lower ledge such the insulator thickness increases toward the electrode firing end. The insulator outer diameter is also typically less than the shell inner diameter so that the corona igniter can be forward-assembled.

18 Claims, 10 Drawing Sheets

Related U.S. Application Data is a continuation of application No. 13/843,336, filed on Mar. 15, 2013, now Pat. No. 9,088,136.

(60) Provisional application No. 61/614,808, filed on Mar. 23, 2012.

(51) Int. Cl.

| | |
|---|---|
| ***H01T 21/02*** | (2006.01) |
| ***F02P 3/01*** | (2006.01) |
| ***F02P 23/04*** | (2006.01) |
| ***H01T 21/00*** | (2006.01) |
| ***H01T 13/36*** | (2006.01) |
| *H01T 19/02* | (2006.01) |
| *H01T 19/04* | (2006.01) |

(52) U.S. Cl.

CPC ..... *H01T 13/36* (2013.01); *H01T 19/00* (2013.01); *H01T 21/00* (2013.01); *H01T 21/02* (2013.01); *H01T 19/02* (2013.01); *H01T 19/04* (2013.01); *Y10T 29/49002* (2015.01); *Y10T 29/49227* (2015.01)

(58) Field of Classification Search

USPC ..... 219/121.45, 121.15, 121.52; 174/138 S; 123/143 B, 536, 606, 608, 146.5 R

See application file for complete search history.

(56) References Cited

U.S. PATENT DOCUMENTS

| | | | | |
|---|---|---|---|---|
| 4,122,816 | A * | 10/1978 | Fitzgerald | F02P 9/007 123/143 B |
| 4,493,297 | A * | 1/1985 | McIlwain | F02P 9/007 123/143 B |
| 4,774,914 | A * | 10/1988 | Ward | F02P 15/04 123/162 |
| 4,841,925 | A * | 6/1989 | Ward | F02P 3/0884 123/143 B |
| 8,844,490 | B2 * | 9/2014 | Burrows | H01T 13/50 123/143 B |
| 9,088,136 | B2 * | 7/2015 | Burrows | H01T 13/50 |
| 2008/0054777 | A1 | 3/2008 | Callahan et al. | |
| 2008/0284303 | A1 | 11/2008 | Agneray et al. | |
| 2009/0189504 | A1 | 7/2009 | Malek et al. | |
| 2010/0052497 | A1 | 3/2010 | Walker, Jr. et al. | |
| 2010/0083942 | A1 * | 4/2010 | Lykowski | F02B 19/12 123/647 |
| 2010/0282197 | A1 * | 11/2010 | Permuy | H01T 19/04 123/143 B |
| 2011/0146640 | A1 | 6/2011 | Achstaetter et al. | |
| 2011/0163654 | A1 | 7/2011 | Malek et al. | |
| 2011/0247579 | A1 | 10/2011 | Hampton et al. | |
| 2013/0234581 | A1 | 9/2013 | Makarov et al. | |
| 2015/0114332 | A1 | 4/2015 | Stifel et al. | |
| 2015/0285206 | A1 * | 10/2015 | Burrows | H01T 13/50 123/143 B |
| 2016/0049773 | A1 | 2/2016 | Stifel et al. | |

FOREIGN PATENT DOCUMENTS

| | | | |
|---|---|---|---|
| EP | 1515408 | A | 3/2005 |
| JP | 2008535195 | A | 8/2008 |
| JP | 2009512172 | A | 3/2009 |
| JP | 2011129511 | A | 6/2011 |
| JP | 2012501521 | A | 1/2012 |
| JP | 2012512980 | A | 6/2012 |
| JP | 2013524478 | A | 6/2013 |
| JP | 2014501432 | A | 1/2014 |
| WO | 201002053 | A2 | 3/2010 |
| WO | 2010025053 | A2 | 3/2010 |

OTHER PUBLICATIONS

International Search Report, dated Nov. 20, 2017 (PCT/US2017/046344).

International Search Report, dated Nov. 8, 2017 (PCT/US2017/046420).

* cited by examiner

CORONA IGNITION DEVICE WITH IMPROVED ELECTRICAL PERFORMANCE

CROSS REFERENCE TO RELATED APPLICATIONS

This U.S. continuation-in-part application claim the benefit of U.S. continuation application Ser. No. 14/742,064, filed Jun. 17, 2015, which claims the benefit of U.S. application Ser. No. 13/843,336, filed Mar. 15, 2013, which claims the benefit of U.S. provisional application Ser. No. 61/614,808, filed Mar. 23, 2012, the entire contents of which are hereby incorporated by reference.

BACKGROUND OF THE INVENTION

1. Field of the Invention

This invention relates generally to a corona igniter for emitting a radio frequency electric field to ionize a fuel-air mixture and provide a corona discharge, and a method of forming the igniter.

2. Related Art

Corona discharge ignition systems include an igniter with a central electrode charged to a high radio frequency voltage potential, creating a strong radio frequency electric field in a combustion chamber. The electric field causes a portion of a mixture of fuel and air in the combustion chamber to ionize and begin dielectric breakdown, facilitating combustion of the fuel-air mixture. The electric field is preferably controlled so that the fuel-air mixture maintains dielectric properties and corona discharge occurs, also referred to as a non-thermal plasma. The ionized portion of the fuel-air mixture forms a flame front which then becomes self-sustaining and combusts the remaining portion of the fuel-air mixture. Preferably, the electric field is controlled so that the fuel-air mixture does not lose all dielectric properties, which would create a thermal plasma and an electric arc between the electrode and grounded cylinder walls, piston, or other portion of the igniter. An example of a corona discharge ignition system is disclosed in U.S. Pat. No. 6,883,507 to Freen.

The corona igniter typically includes the central electrode formed of an electrically conductive material for receiving the high radio frequency voltage and emitting the radio frequency electric field to ionize the fuel-air mixture and provide the corona discharge. The electrode typically includes a high voltage corona-enhancing electrode tip emitting the electrical field. The igniter also includes a shell formed of a metal material receiving the central electrode and an insulator formed of an electrically insulating material is disposed between the shell and the central electrode. The igniter of the corona discharge ignition system does not include any grounded electrode element intentionally placed in close proximity to a firing end of the central electrode. Rather, the ground is preferably provided by cylinder walls or a piston of the ignition system. An example of a corona igniter is disclosed in U.S. Patent Application Publication No. 2010/0083942 to Lykowski and Hampton.

During operation of high frequency corona igniters, there is an electrical advantage if the insulator outer diameter increases in a direction moving away from the grounded metal shell and towards the high voltage electrode tip. An example of this design is disclosed in U.S. Patent Application Publication No. 2012/0181916. For maximum benefit it is often desirable to make the outer diameter larger than the inner diameter of the grounded metal shell. This design has resulted in the need to assemble the igniter by inserting the insulator into the shell from the direction of the combustion chamber, referenced to as "reverse-assembly".

SUMMARY OF THE INVENTION

One aspect of the invention provides a corona igniter comprising a central electrode, an insulator surrounding the central electrode, and a conductive component surrounding the insulator. The central electrode is formed of an electrically conductive material for receiving a high radio frequency voltage and emitting a radio frequency electric field. The insulator is formed of an electrically insulating material and extends longitudinally along a center axis from an insulator upper end to an insulator nose end. The insulator includes an insulator outer surface extending from the insulator upper end to the insulator nose end, and the insulator outer surface presents an insulator outer diameter extending across and perpendicular to the center axis. The insulator also includes an insulator body region and an insulator nose region. The insulator outer surface includes a lower ledge extending outwardly away from the center axis between the insulator body region and the insulator nose region. The lower ledge presents an increase in the insulator outer diameter.

The conductive component is formed of electrically conductive material and surrounds at least a portion of the insulator body region such that the insulator nose region extends outwardly of the conductive component. The conductive component includes a shell surrounding at least a portion of the insulator body region and extending from a shell upper end to a shell firing end. The shell presents a shell inner surface facing the center axis and extending along the insulator outer surface from the shell upper end to the shell firing end. The shell inner surface also presents a shell inner diameter extending across and perpendicular to the center axis.

The conductive component also includes an intermediate part surrounding a portion of the insulator body region and extending longitudinally from an intermediate upper end to an intermediate firing end. For example, the intermediate part can be layer of metal which brazes the insulator to the shell. The intermediate part includes an intermediate inner surface facing the center axis and extending longitudinally along the insulator outer surface from the intermediate upper end to the intermediate firing end. The intermediate inner surface presents a conductive inner diameter extending across and perpendicular to the center axis, and the conductive inner diameter is less than the insulator outer diameter along a portion of the insulator located between the lower ledge and the insulator nose end. The intermediate part is disposed between the insulator upper end and the lower ledge.

Another aspect of the invention provides a method of forming the corona igniter. The method comprises disposing the intermediate part between the insulator upper end and the lower ledge; and disposing a shell formed of an electrically conductive material around the intermediate part and the insulator.

The corona igniter of the present invention provides exceptional electrical performance because the conductive inner diameter is less than the insulator outer diameter adjacent the insulator nose region. The corona igniter can also be reverse-assembled.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE EXAMPLE EMBODIMENTS

Figure 1:
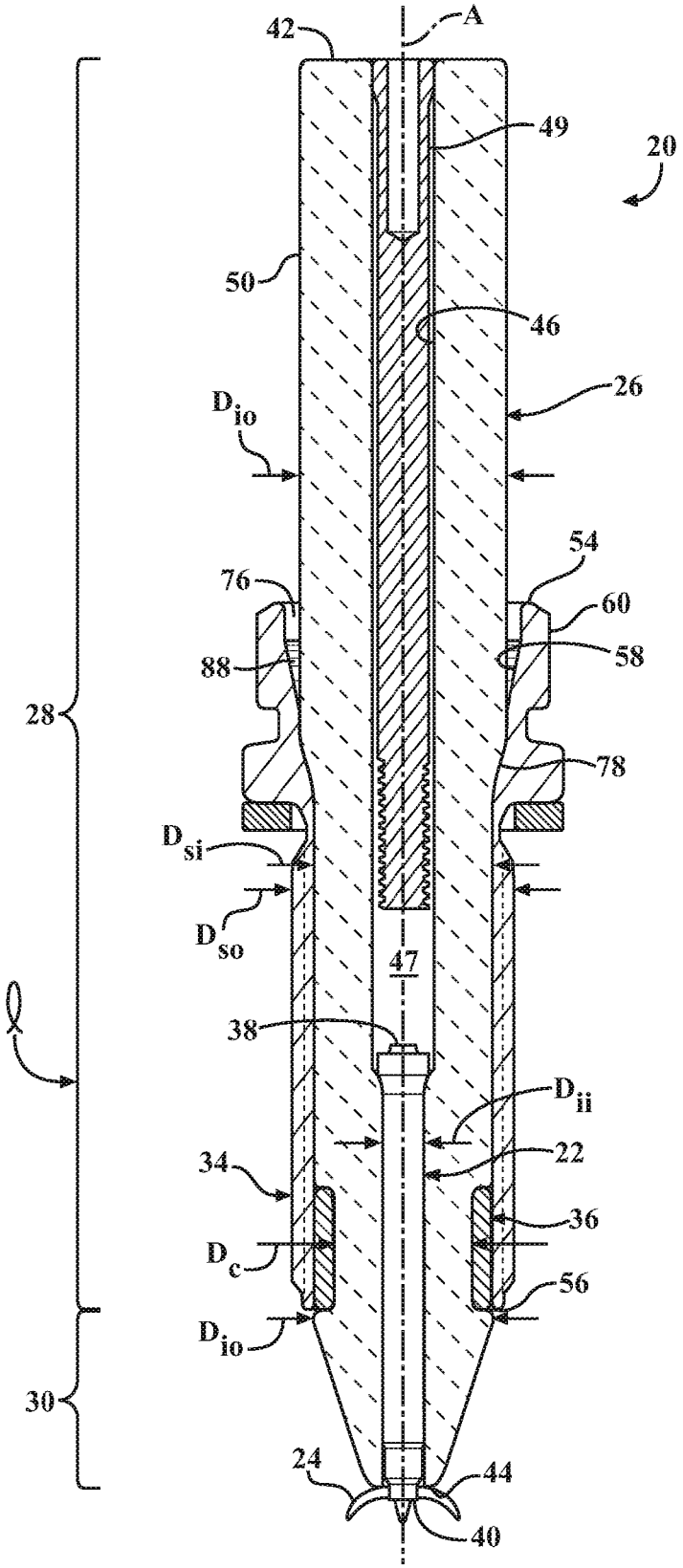
FIG. 1 is a cross-sectional view of a corona igniter manufactured using a forward-assembly method according to one exemplary embodiment of the invention.
Figure 1A:
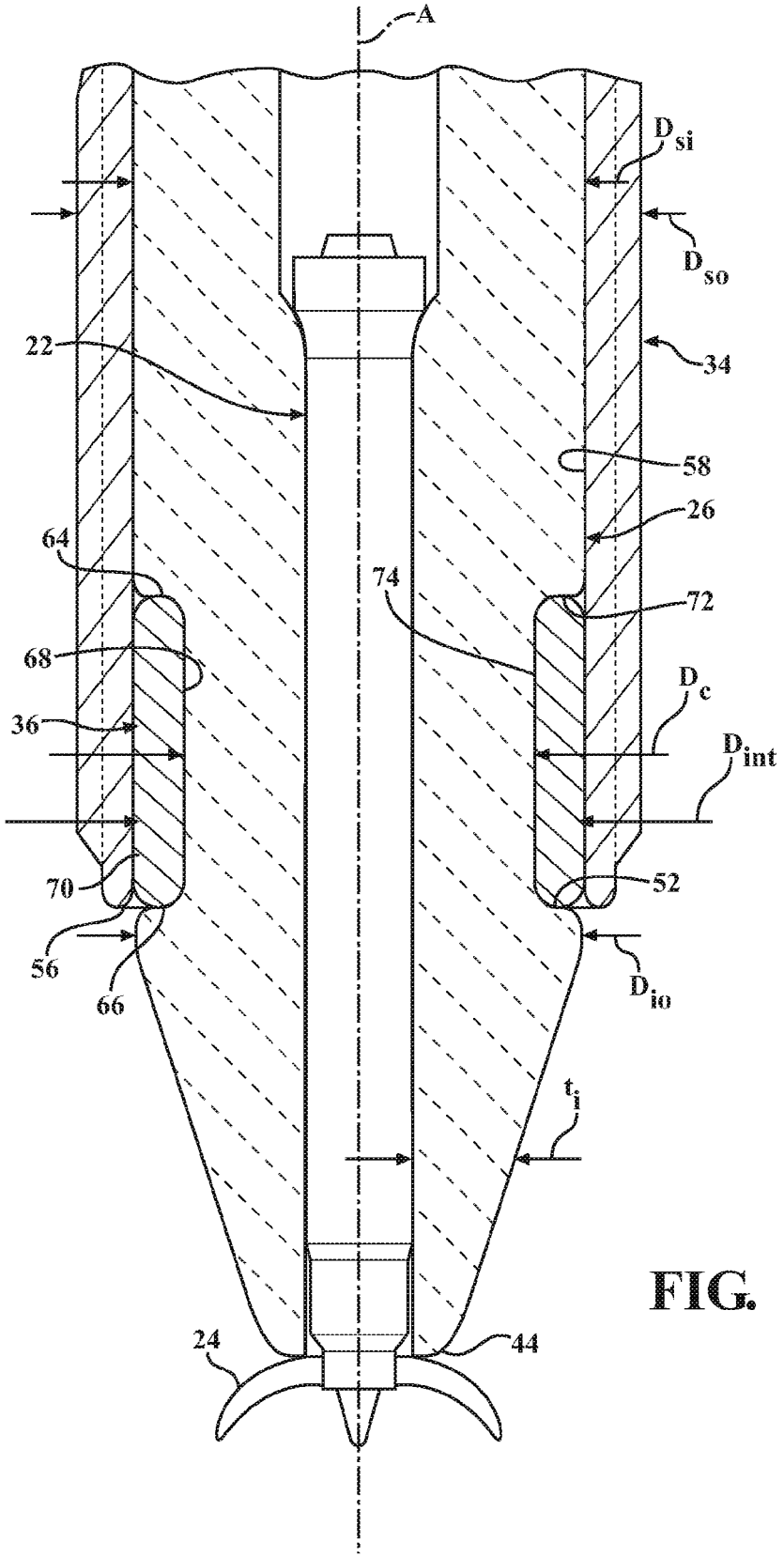
FIG. 1A is an enlarged view of a portion of the corona igniter of FIG. 1 showing an intermediate part, an insulator nose region, and a portion of an insulator body region.

Exemplary embodiments of a corona igniter 20 are shown in FIGS. 1-8. The corona igniter 20 includes a central electrode 22 for receiving a high radio frequency voltage. The central electrode 22 includes a corona-enhancing tip 24 for emitting a radio frequency electric field to ionize a fuel-air mixture and provide a corona discharge. An insulator 26 surrounds the central electrode 22. The insulator 26 includes an insulator body region 28 and an insulator nose region 30 presenting an insulator outer diameter $D_{io}$. The corona igniter 20 also comprises a conductive component including a metal shell 34 and an intermediate part 36 presenting a conductive inner diameter $D_c$. The insulator outer diameter $D_{io}$ along a portion of the insulator nose region 30 is greater than the conductive inner diameter $D_c$. The insulator outer diameter $D_{io}$ increases in a direction moving away from the metal shell 34 and towards the high voltage corona enhancing tip 24, which provides the corona igniter 20 with an electrical benefit during operation.

The central electrode 22 of the corona igniter 22 is formed of an electrically conductive material for receiving the high radio frequency voltage, typically in the range of 20 to 75 KV peak/peak. The central electrode 22 also emits a high radio frequency electric field, typically in the range of 0.9 to 1.1 MHz. The central electrode 22 extends longitudinally along a center axis A from a terminal end 38 to an electrode firing end 40. The central electrode 22 typically includes a corona enhancing tip 24 at the electrode firing end 40, for example a tip including a plurality of prongs, as shown in FIGS. 1-8.

The insulator 26 of the corona igniter 20 is formed of an electrically insulating material. The insulator 26 surrounds the central electrode 22 and extends longitudinally along the center axis A from an insulator upper end 42 to an insulator nose end 44. The electrode firing end 40 is typically disposed outwardly of the insulator nose end 44, as shown in FIGS. 1-8. An insulator inner surface 46 surrounds an insulator bore receiving the central electrode 22. A conductive seal 47 is typically used to secure the central electrode 22 and an electrical contact 49 in the insulator bore.

The insulator inner surface 46 also presents an insulator inner diameter $D_{ii}$ extending across and perpendicular to the center axis A. The insulator 26 includes an insulator outer surface 50 extending from the insulator upper end 42 to the insulator nose end 44. The insulator outer surface 50 also presents the insulator outer diameter $D_{io}$ extending across and perpendicular to the center axis A. The insulator inner diameter $D_{ii}$ is preferably 15 to 25% of the insulator outer diameter $D_{io}$.

As shown in FIG. 1, the insulator 26 includes the insulator body region 28 and the insulator nose region 30. The insulator outer surface 50 includes a lower ledge 52 extending outwardly away from and transverse to the center axis A between the insulator body region 28 and the insulator nose region 30. The lower ledge 52 presents an increase in the insulator outer diameter $D_{io}$. The insulator body region 28 and insulator nose region 30 can have various different designs and dimensions with the lower ledge 52 disposed therebetween, other than the designs and dimensions shown in the Figures.

The conductive component of the corona igniter 20 surrounds at least a portion of the insulator body region 28 such that the insulator nose region 30 extends outwardly of the conductive component, as shown in the Figures. The conductive component includes the shell 34 and the intermediate part 36, both formed of electrically conductive metal. The shell 34 and the intermediate part 36 can be formed of the same or different electrically conductive materials.

The shell 34 is typically formed of a metal material, such as steel, and surrounds at least a portion of the insulator body region 28. The shell 34 extends along the center axis A from a shell upper end 54 to a shell firing end 56. The shell 34 presents a shell inner surface 58 facing the center axis A and extending along the insulator outer surface 50 from the shell upper end 54 to the shell firing end 56. The shell 34 also includes a shell outer surface 60 facing opposite the shell inner surface 58 and presenting a shell outer diameter $D_{so}$. The shell inner surface 58 presents a shell bore surrounding the center axis A and a shell inner diameter $D_{si}$ extending across and perpendicular to the center axis A. The shell inner diameter $D_{si}$ is typically greater than or equal to the insulator outer diameter $D_{io}$ along the entire length l of the insulator 26 from the insulator upper end 42 to the insulator nose end 44, so that the corona igniter 20 can be forward-assembled. The length of the insulator 26 includes both the body region 28 and the nose region 30. The term "forward-assembled" means that the insulator nose end 44 can be inserted into the shell bore through the shell upper end 54, rather than through the shell firing end 56. However, in an alternate embodiment, the shell inner diameter $D_{si}$ is less than or equal to the insulator outer diameter $D_{io}$ along a portion of the length l of the insulator 26 from the insulator upper end 42 to the insulator nose end 44, and that the corona igniter 20 is reversed assembled. The term "reverse-assembled" means that the insulator upper end 42 is inserted into the shell bore through the shell firing end 56.

The intermediate part 36 of the corona igniter 20 is disposed inwardly of the shell 34 and surrounds a portion of the insulator body region 28. The intermediate part 36 is disposed along the insulator body region 28 directly above the insulator nose region 30. It extends longitudinally from an intermediate upper end 64 to an intermediate firing end 66. The intermediate part 36 is rigidly attached to the insulator outer surface 50. Preferably, the intermediate inner surface 68 is hermetically sealed to the insulator outer surface 50, to close the axial joint and avoid gas leakage during use of the corona igniter 20 in a combustion engine.

The intermediate part 36 is typically formed of a metal or metal alloy containing one or more of nickel, cobalt, iron, copper, tin, zinc, silver, and gold. The metal or metal alloy can be cast into place on the insulator outer surface 50. Alternatively, the intermediate part 36 can be glass or ceramic based and made conductive by the addition of one or more of the above metals or metal alloys. The glass or ceramic based intermediate part 36 can be formed and sintered directly into place on the insulator outer surface 50. The intermediate part 36 can also be provided as a metal ring attached in place to the insulator outer surface 50 by soldering, brazing, diffusion bonding, high temperature adhesive, or another method. The intermediate part 36 is also attached to the shell inner surface 58, preferably by any suitable method, including soldering, brazing, welding, interference fit, and thermal shrink fit. The material used to form the intermediate part 36 is preferably conformable and is able to absorb stresses occurring during operation, without passing them to the insulator 26.

In another embodiment, the intermediate part 36 brazes the insulator 26 to the shell 34. In this embodiment, the intermediate part 36 is a thin layer of metal containing one or more of nickel, cobalt, iron, copper, tin, zinc, silver, and gold. The metal is provided in liquid form and flows between the insulator 26 and the shell 34, and then allowed to solidify to braze the insulator 26 to the shell 34. The layer of metal can be applied before or after disposing the insulator 26 in the shell 34. In addition, the intermediate part 28 can be used to braze the insulator 26 to the shell 34 in either the forward or reverse assembly igniters 22.

In one example embodiment, the intermediate part 28 is formed from a solid piece of metal, specifically a solid ring formed of a silver (Ag) and/or copper (Cu) alloy disposed around the insulator 26. Next, the shell 34 is disposed around the insulator 26, and the assembly is heated at which time the solid ring, referred to as a braze, becomes liquid and is wicked into an area, referred to as a "braze area," through capillary action. As the parts cool, the liquid alloy solidifies to provide the intermediate part 36 brazed to the insulator 26 and to the shell 34. This process puts the ceramic insulator 26 in compression because of the differences in shrinkage of the components after the alloy solidifies and as the parts cool. During operation, the engine temperature does not reach the melting point of the braze alloy used to form intermediate part 36, so that it stays solid during engine operation. Alternatively, the intermediate part 36 could be formed by brazing the solid ring to the insulator 26 and shell 34 by another metal material, such as another metal having a lower melting point than the solid ring, using the brazing process described above.

The intermediate inner surface 68 of the intermediate part 36 faces the center axis A and extends longitudinally along the insulator outer surface 50 from the intermediate upper end 64 to the intermediate firing end 66. The intermediate part 36 also includes an intermediate outer surface 70 facing opposite the intermediate inner surface 68 and extending longitudinally from the intermediate upper end 64 to the intermediate firing end 66. The intermediate outer diameter $D_{int}$ is typically less than or equal to the shell outer diameter $D_{so}$, as shown in FIGS. 1-7, but may be greater than the shell inner diameter $D_{si}$, as shown in FIG. 8. The intermediate inner surface 68 presents a conductive inner diameter $D_c$ extending across and perpendicular to the center axis A. The conductive inner diameter $D_c$ is less than the insulator outer diameter $D_{io}$ at the lower ledge 52 of the insulator 26, which is between the insulator nose region 30 and the insulator body region 28. In addition, the insulator 26 also presents a thickness $t_i$ that increases adjacent the shell firing end 56 and adjacent the intermediate firing end 66. The insulator thickness $t_i$ increases in the direction toward the electrode firing end 40. This feature provides the electrical advantages achieved in the reverse-assembled igniters of the prior art, while still allowing use the forward-assembly method. The conductive inner diameter $D_c$ is typically 80 to 90% of the insulator outer diameter $D_{io}$ directly below the lower ledge 52.

The conductive inner diameter $D_c$ is typically equal to 75 to 90% of the shell inner diameter $D_{si}$ along the intermediate part 36. As shown in FIGS. 1-8, the intermediate firing end 66 preferably engages the lower ledge 52 of the insulator 26 and is longitudinally aligned with the shell firing end 56. Also shown in FIGS. 1-8, the insulator outer diameter $D_{io}$ typically tapers from the lower ledge 52 along the insulator nose region 30 to the insulator nose end 44.

Figure 2:
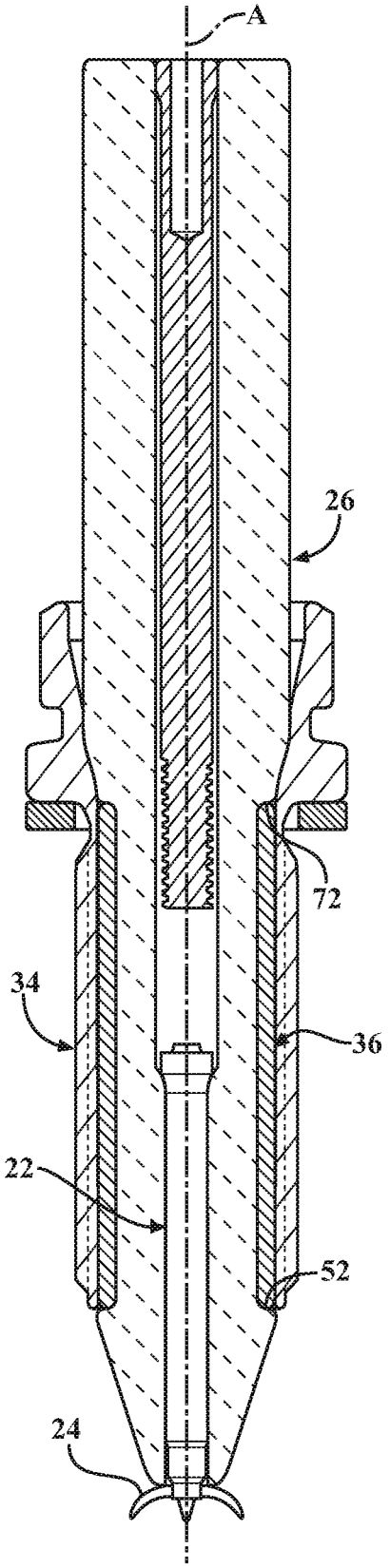
FIGS. 2-9 are cross-sectional views of corona igniters according to other exemplary embodiment of the invention.

The exemplary embodiments of the corona igniter 20 can include various different features. In the exemplary embodiments of FIGS. 1-3 and 5-8, the insulator outer surface 50 of the insulator body region 28 presents an upper ledge 72 extending inwardly toward the center axis A such that the upper ledge 72 and the lower ledge 52 present a recess 74 therebetween. The intermediate part 36 is disposed in the recess 74 and typically extends along the entire length of the recess 74. Preferably the intermediate upper end 64 engages the upper ledge 72 and the intermediate firing end 66 engages the lower ledge 52 to restrict movement of the intermediate part 36 during assembly and in operation. The length of the recess 74 and intermediate part 36 can vary. For example, the length of the recess 74 and intermediate part 36 can extend along one quarter or less of the length l of the insulator 26, as shown in FIGS. 1, 3, and 6-8. Alternatively, the length of the recess 74 and intermediate part 36 can extend along greater than one quarter of the length l of the insulator 26, as shown in FIGS. 2 and 4. Extending the length intermediate part 36, as shown in FIGS. 2 and 4, improves thermal performance and removes any small air gaps within the assembly, which improves electrical performance.

In the exemplary embodiments of FIGS. 1-5 and 8, the shell inner surface 58 of the corona igniter 20 extends away from the insulator outer surface 50 adjacent the shell upper end 54 to present a crevice 76 between the shell inner surface 58 and the insulator outer surface 50. A filler material 88 at least partially fills the crevice 76 between the insulator outer surface 50 and the shell inner surface 58 adjacent the shell upper end 54. The filler material 88 is typically an adhesive attaching the insulator 26 to the shell 34 and prevents the insulator 26 from entering the combustion chamber, in the case of failure of the joints at the intermediate part 36. The filler material 88 can also provide improved electrical and thermal performance, as well as increased stability. The filler material 88 may be electrically insulating, such as a ceramic-loaded adhesive, silicone, or epoxy-based filler, PTFE, a printable carrier, a paintable carrier, or tampered powder. The filler material 88 can alternatively be electrically conductive, such a metal-loaded epoxy, a printable carrier or paintable carrier including conductive materials, a solder, or a braze. If the filler material 88 provides adequate adhesion, mechanical strength, and thermal performance, it is possible to omit the step of rigidly attaching the intermediate part 36 to the insulator 26. The intermediate part 36 is attached to the shell 34, as before, and makes the insulator 26 captive. In this embodiment, the filler material 88 can provide the gas-tight seal, instead of the joints along the intermediate part 36. However, the intermediate inner surface 68 should still fit closely against the insulator outer surface 50, or against the ledges 52, 72 and recess 74, to restrict possible movement of the components during operation.

In the exemplary embodiments of FIGS. 1 and 8, the insulator outer diameter $D_{io}$ is constant from the upper ledge 72 along a portion of the insulator body region 28 toward the insulator upper end 42 and then increases gradually along a portion of the insulator body region 28 toward the insulator upper end 42. The insulator outer diameter $D_{io}$ is constant from the gradual increase to the insulator upper end 42. The gradual increase helps to achieve accurate assembly, supports the upper body region, improves thermal performance, and prevents the insulator 26 from entering into the combustion chamber in the case of failure of the joints along the intermediate part 36. A conformal element 78 can be placed between the insulator 26 and the shell 34 along the gradual increase. The conformal element 78 is typically formed of a soft metal gasket formed of copper or annealed steel, or a plastic or rubber material. In the exemplary embodiments of FIGS. 1 and 8, the crevice 76 extends from the gradual transition toward the insulator upper end 42.

In the exemplary embodiment of FIG. 2, the insulator outer diameter $D_{io}$ increases gradually from the upper ledge 72 toward the insulator upper end 42 and is constant from the gradual increase to the insulator upper end 42. In this embodiment, the crevice 76 also extends from the gradual increase toward the insulator upper end 42.

Figure 3:
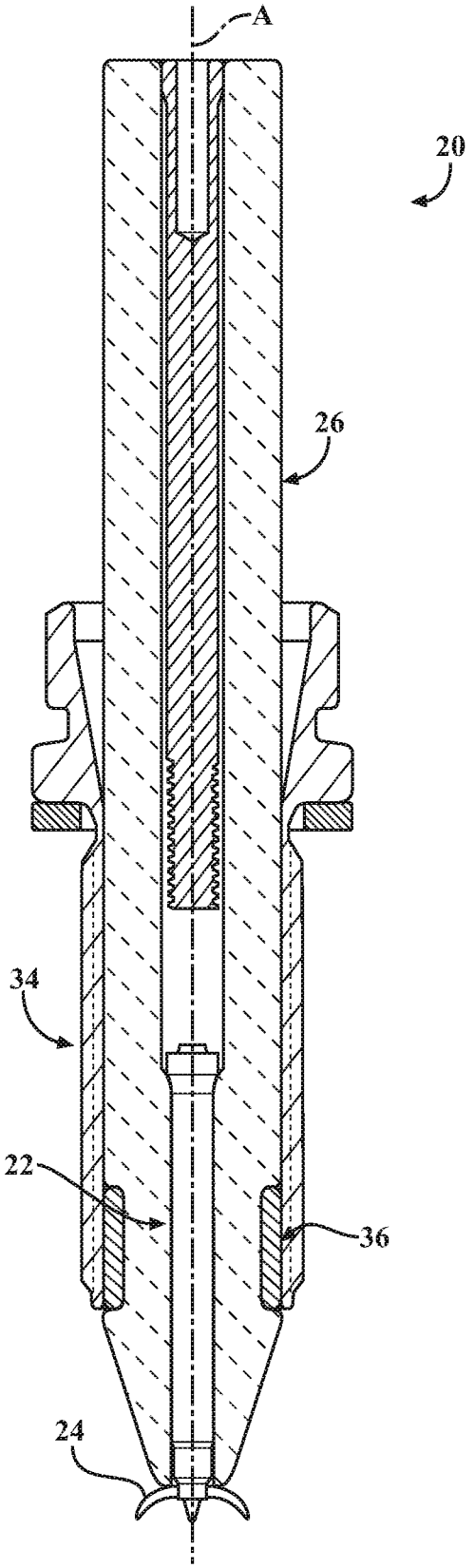
Figure 4:
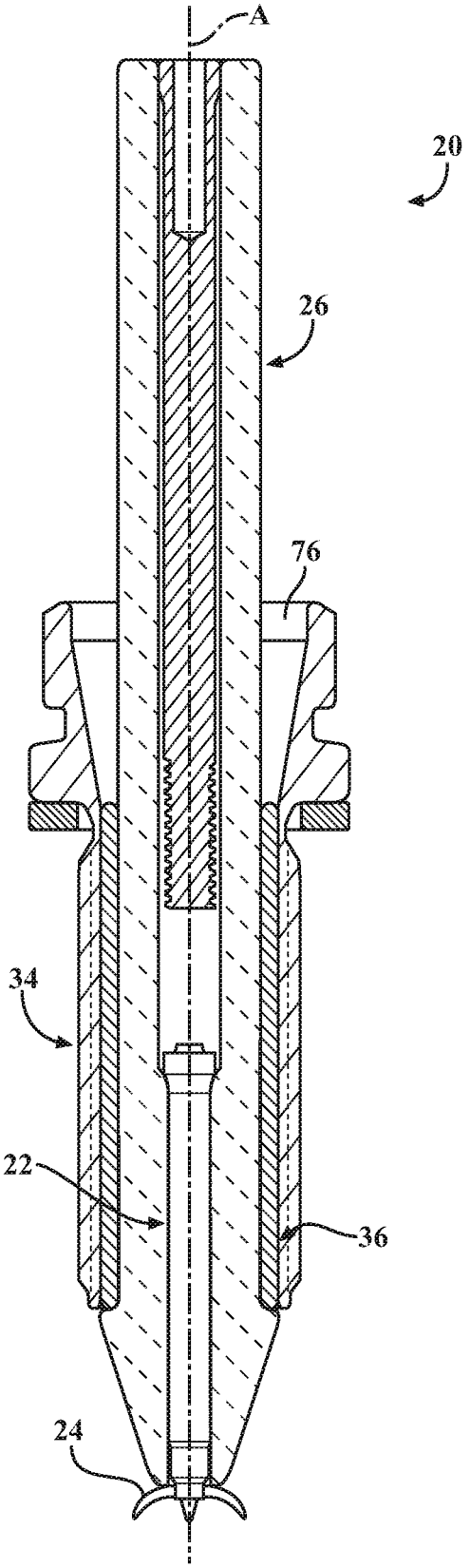
Figure 5:
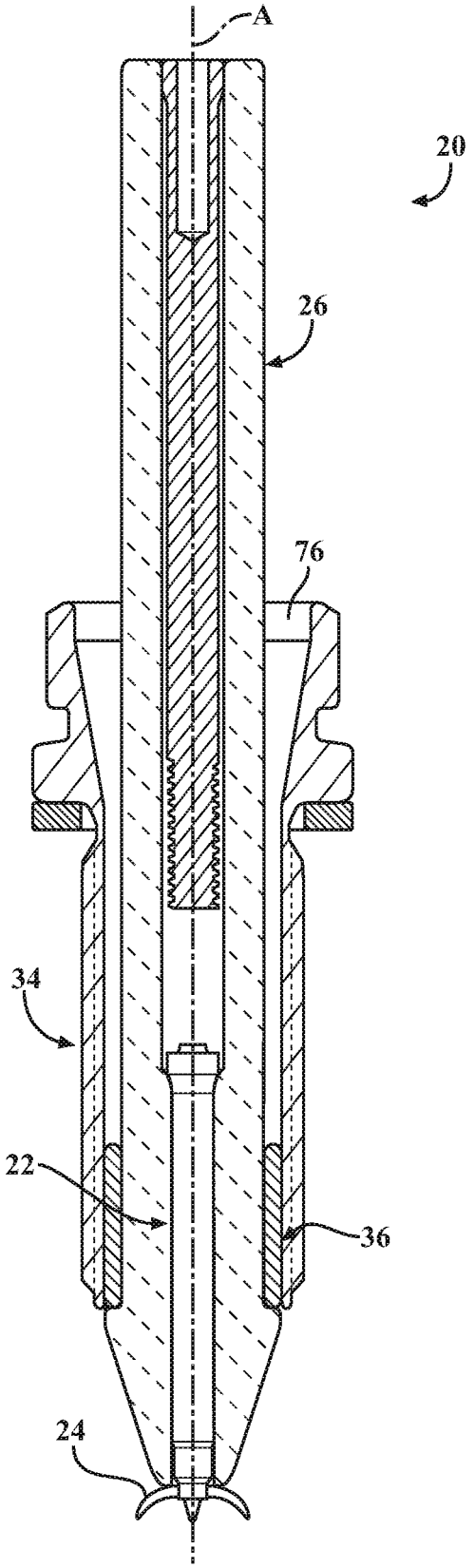

In the exemplary embodiment of FIG. 3, the insulator outer diameter $D_{io}$ is constant from the upper ledge 72 to the insulator upper end 42. This makes it easier to avoid putting the insulator 26 in tension during operation. In this embodiment, the corona igniter 20 could be forward-assembled or reverse-assembled. However, it may be desirable to increase the insulator outer diameter $D_{io}$ along or above the crevice 76 to interface properly with other system components (not shown). Alternatively, a separate component (not shown) could be added to increase the insulator outer diameter $D_{io}$ along or above the crevice 76.

FIG. 4 illustrates yet another exemplary embodiment, wherein the crevice 76 extends from the intermediate upper end 64 to the shell upper end 54. In this embodiment, the insulator outer diameter $D_{io}$ is constant from the lower ledge 52 to the insulator upper end 42. In the exemplary embodiment of FIG. 5, the insulator outer diameter $D_{io}$ decreases slightly above the intermediate upper end 64, along the insulator body region 28 between the lower ledge 52 and the insulator upper end 42.

Figure 6:
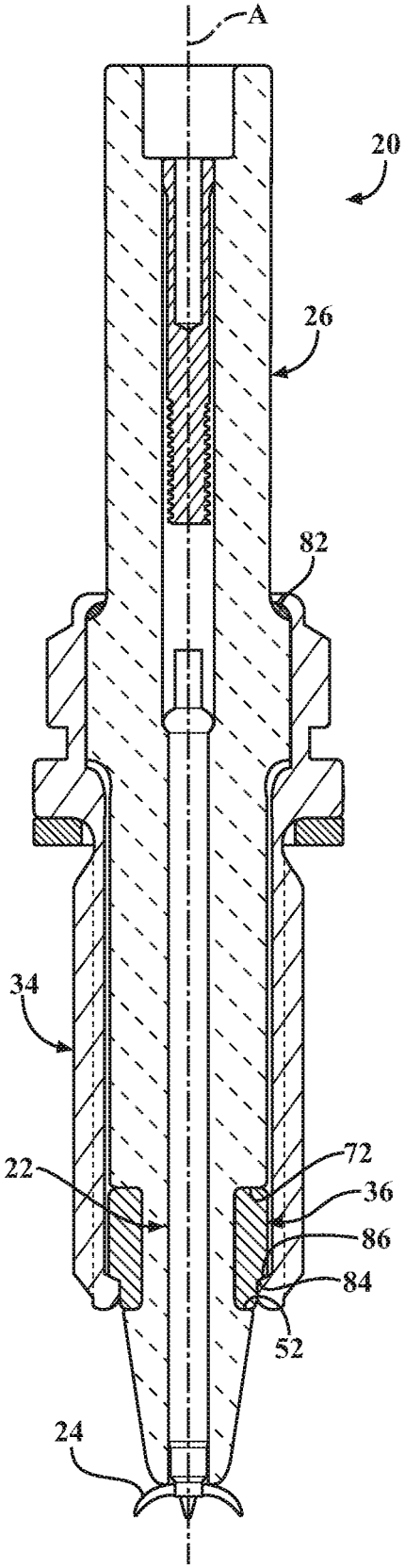
Figure 7:
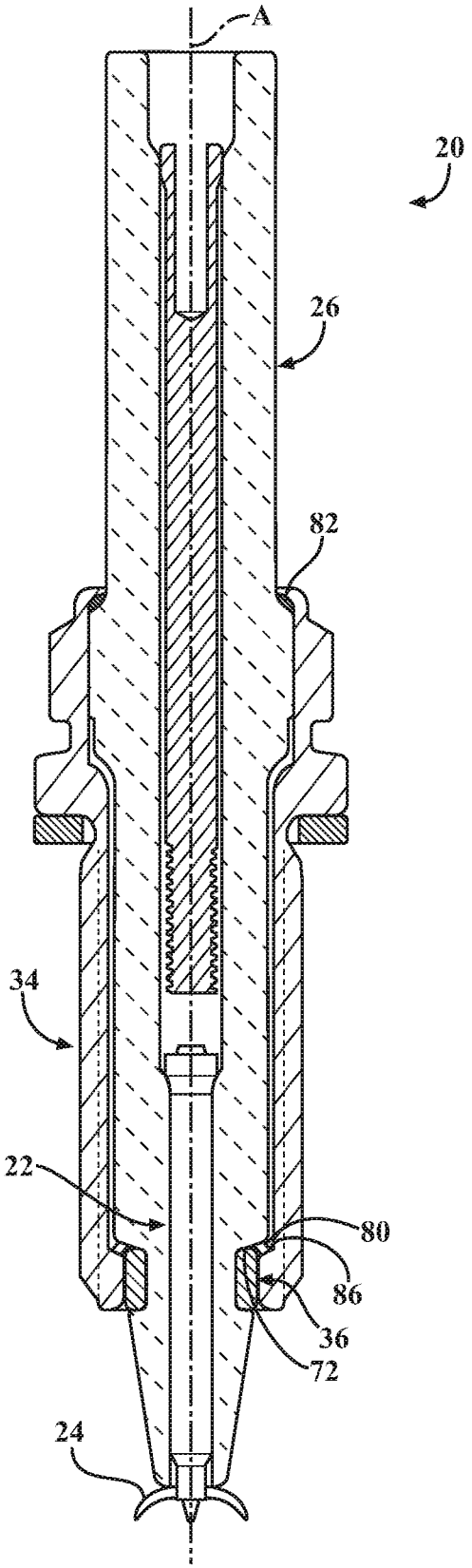
Figure 8:
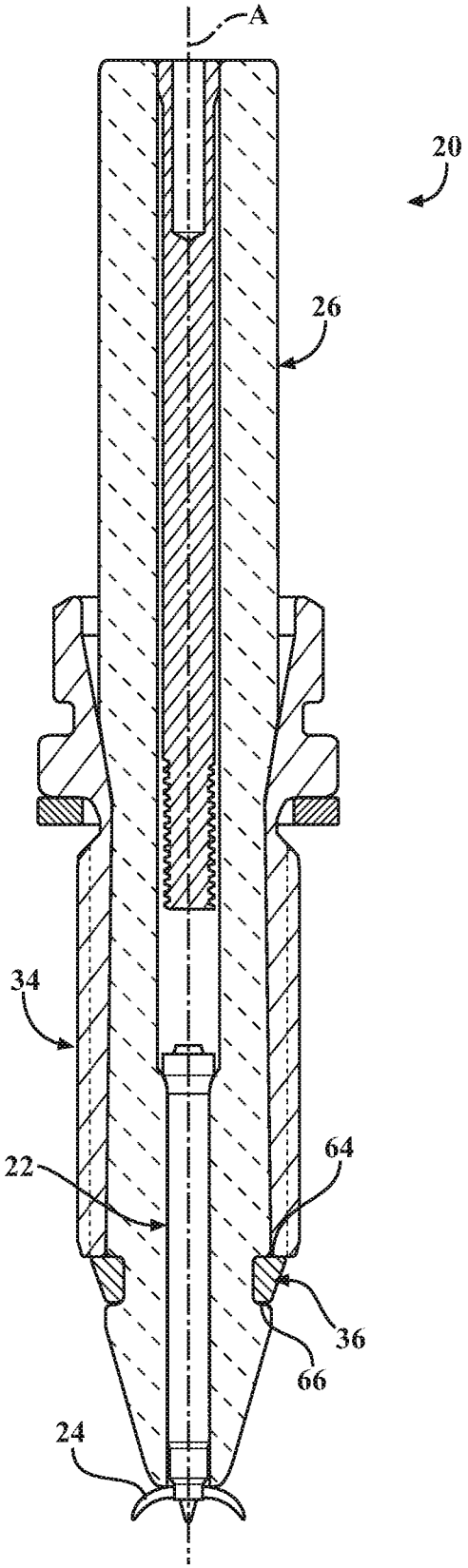
Figure 9:
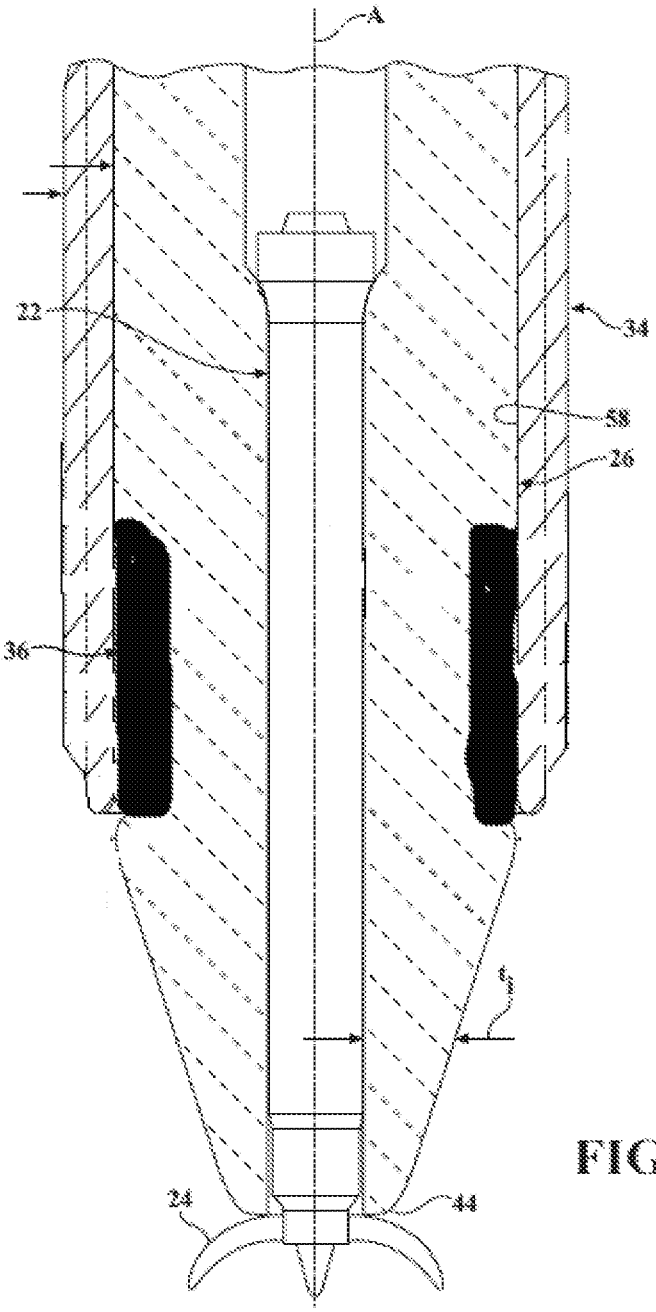

FIGS. 6 and 7 illustrate other exemplary embodiments wherein the insulator outer diameter $D_{io}$ is constant from the upper ledge 72 to a turnover region. The insulator 26 diameter increases at the turnover region and then decreases to present a turnover shoulder 82 for supporting and engaging the shell upper end 54. The insulator outer diameter $D_{io}$ is then constant from the turnover shoulder 82 to the insulator upper end 42. In these embodiments, the shell upper end 54 turns over and engages the insulator outer surface 50 at the turnover shoulder 82 ad holds the insulator 26 captive in the shell 34. This puts the insulator 26 in compression and can form a gas-tight seal between the intermediate part 36 and insulator 26 along the intermediate upper end 64 and intermediate firing end 66. If the gas-tight seal is achieved, the step of brazing or otherwise attaching the intermediate part 36 to the insulator 26 and shell 34 may be omitted.

In the exemplary embodiment of FIG. 6, the intermediate inner surface 68 presents a conductive inner diameter $D_c$ extending across and perpendicular to the center axis A, and the conductive inner diameter $D_c$ is less than the insulator outer diameter $D_{io}$ directly below the lower ledge 52 of the insulator 26. The intermediate firing end 66 engages the lower ledge 52 of the insulator 26, as in the other embodiments. However, in this embodiment, the intermediate outer surface 70 includes an intermediate seat 84 between the intermediate upper end 64 and the intermediate firing end 66, and the intermediate outer diameter $D_{int}$ decreases along the intermediate seat 84 toward the intermediate firing end 66. In addition, the shell inner surface 58 presents a shell seat 86 extending toward the intermediate outer surface 70. The shell seat 86 is aligned, parallel to, and engages the intermediate seat 84. In addition, the shell 34 has a thickness $t_s$ extending from the shell inner surface 58 to the shell outer surface 60 and the thickness $t_s$ increases at the shell seat 86.

In the exemplary embodiment of FIG. 7, the shell 34 again includes the shell seat 86 facing the insulator 26 upper ledge 72. The shell inner diameter $D_{si}$ decreases along the shell seat 86 toward the shell firing end 56. A gasket 80 is disposed between and separates the shell seat 86 and the insulator 26 upper ledge 72. The gasket 80 is compressed between the insulator outer surface 50 and the shell seat 86 to provide a seal. In this embodiment, the intermediate part 36 does not need to seal against gas pressure or retain the insulator 26, and it may be press fit to the shell 34 during assembly. In this embodiment, the insulator outer diameter $D_{io}$ at the upper ledge 72 is greater than the insulator outer diameter $D_{io}$ at the lower ledge 52. Like the embodiment of FIG. 6, the shell 34 thickness $t_s$ increases at the shell seat 86.

In the exemplary embodiment of FIG. 8, the intermediate outer diameter $D_{int}$ at the intermediate upper end 64 is greater than the insulator outer diameter $D_{io}$ of the upper ledge 72 of the insulator 26. The intermediate upper end 64 extends radially outwardly relative to the insulator outer surface 50, and the shell firing end 56 is disposed on the intermediate upper end 64. In this embodiment, the conductive inner diameter $D_c$ from the intermediate upper end 64 to the intermediate firing end 66 is constant and the intermediate outer diameter $D_{int}$ tapers from the intermediate upper end 64 to the intermediate firing end 66.

Another aspect of the invention provides a method of forming the corona igniter 20. The method can be a forward-assembly method, which includes inserting the insulator nose end 44 into the shell bore through the shell upper end 54, rather than the shell firing end 56 as in the reverse-assembly method. However, the method could alternatively comprise a reverse assembly method, wherein the shell inner diameter $D_{si}$ is less than or equal to the insulator outer diameter $D_{io}$ along a portion of the insulator 26, and the method includes inserting the insulator nose end 44 into the shell bore through the shell firing end 56.

The method of forming the corona igniter 20 includes control of forces and material temperatures such that the insulator 26 is not placed in tension, either during assembly, or due to differential thermal expansion during operation.

The method includes providing the insulator 26 formed of the electrically insulating material extending along the center axis A from the insulator upper end 42 to the insulator nose end 44. The insulator 26 includes the insulator outer surface 50 extending from the insulator upper end 42 to the insulator nose end 44. The insulator outer surface 50 presents the insulator outer diameter $D_{in}$ and includes the lower ledge 52 extending outwardly away from and transverse to the center axis A between the insulator body region 28 and the insulator nose region 30.

The method also includes disposing the intermediate part 36 formed of the electrically conductive material on the lower ledge 52 of the insulator 26. This step is typically conducted before the insulator 26 is inserted into the shell 34. However, if the intermediate outer diameter $D_{int}$ is greater than the shell inner diameter $D_{si}$, as in the corona igniter 20 of FIG. 8, then the intermediate part 36 is disposed on the lower ledge 52 after inserting the insulator 26 into the shell 34.

The method also includes rigidly attaching the intermediate part 36 to the insulator outer surface 50, typically before inserting the insulator 26 into the shell 34. The attaching step typically includes casting, sintering, brazing, soldering, diffusion bonding, or applying a high temperature adhesive between the intermediate part 36 and insulator outer surface 50. If the intermediate part 36 is a metal or metal alloy, the attaching step typically includes casting. If the intermediate part 36 is glass or ceramic based, the attaching step typically includes forming and sintering directly into place around the insulator outer surface 50. If the intermediate part 36 is a metal ring, then the attaching step typically includes soldering, diffusion bonding, or applying a high temperature adhesive between the intermediate part 36 and insulator outer surface 50. The method typically includes hermetically sealing the intermediate part 36 to the insulator 26 to close the axial joint and avoid gas leakage during use of the corona igniter 20.

The method also includes providing the shell 34 formed of the electrically conductive material extending along and around the center axis A from the shell upper end 54 to the shell firing end 56. The shell 34 includes the shell inner surface 58 extending from the shell upper end 54 to the shell firing end 56, and the shell inner surface 58 presents the shell bore extending along the center axis A. In each exemplary embodiment, the shell inner diameter $D_{si}$ is greater than or equal to the insulator outer diameter $D_{io}$.

The method next includes inserting the insulator 26 into the shell 34 in the forward-assembly direction. This step is typically conducted after attaching the intermediate part 36 to the insulator 26, but may be done before. This step includes inserting the insulator nose end 44 through the shell upper end 54 into the shell bore. The insulator 26 should be moved along the shell inner surface 58 until the insulator nose end 44 extends outwardly of the shell firing end 56. To manufacture the exemplary embodiments of FIGS. 1-7, this step includes aligning the shell firing end 56 with the lower ledge 52 of the insulator 26 and the intermediate firing end 66. To manufacture the exemplary embodiment of FIG. 8, the method includes inserting the insulator 26 into the shell 34 followed by disposing the intermediate part 36 along the insulator outer surface 50 such that the intermediate upper end 64 engages the shell firing end 56.

The method may also include disposing the filler material 88 in the crevices 76 between the insulator 26 and shell upper end 54. This step may include filling at least a portion of the crevice 76 with the filler material 88. Alternatively, the filler material 88 can be applied to both the insulator outer surface 50 and shell inner surface 58 before inserting the insulator 26 into the shell 34, such that when the insulator 26 and shell 34 are connected, the filler material 88 at least partially fills the crevice 76. If the filler material 88 provides a gas-tight seal, then it is possible to omit the step of rigidly attaching the intermediate part 36 to the insulator 26.

Obviously, many modifications and variations of the present invention are possible in light of the above teachings and may be practiced otherwise than as specifically described while within the scope of the appended claims.

What is claimed is:

1. A corona igniter for emitting a radio frequency electric field to ionize a fuel-air mixture and provide a corona discharge, comprising:

a central electrode formed of an electrically conductive material for receiving a high radio frequency voltage and emitting the radio frequency electric field;

an insulator formed of an electrically insulating material surrounding said central electrode and extending longitudinally along a center axis from an insulator upper end to an insulator nose end;

said insulator including an insulator outer surface extending from said insulator upper end to said insulator nose end;

said insulator outer surface presenting an insulator outer diameter extending across and perpendicular to said center axis;

said insulator including an insulator body region and an insulator nose region;

said insulator outer surface including a lower ledge extending outwardly away from said center axis between said insulator body region and said insulator nose region;

said lower ledge presenting an increase in said insulator outer diameter;

a conductive component surrounding at least a portion of said insulator body region such that said insulator nose region extends outwardly of said conductive component;

said conductive component including a shell surrounding at least a portion of said insulator body region and extending from a shell upper end to a shell firing end;

said shell presenting a shell inner surface facing said center axis and extending along said insulator outer surface from said shell upper end to said shell firing end;

said conductive component including an intermediate part formed of an electrically conductive material and surrounding a portion of said insulator body region and extending longitudinally from an intermediate upper end to an intermediate firing end;

said intermediate part including an intermediate inner surface facing said center axis and extending longitudinally along said insulator outer surface from said intermediate upper end to said intermediate firing end;

said intermediate inner surface presenting a conductive inner diameter extending across and perpendicular to said center axis;

said conductive inner diameter being less than said insulator outer diameter along a portion of said insulator located between said lower ledge and said insulator nose end;

said intermediate part being disposed between said insulator upper end and said lower ledge;

said intermediate part being a layer of metal, and said layer of metal brazes said insulator to said shell.

2. The corona igniter of claim 1, wherein said insulator outer surface of said insulator body region presents an upper ledge extending inwardly toward said center axis, and said insulator outer surface presents a recess extending longitudinally from said upper ledge to said lower ledge, and said intermediate part is disposed in said recess.

3. The corona igniter of claim 1, wherein said shell inner surface presents a shell inner diameter extending across and perpendicular to said center axis; and said shell inner diameter is greater than or equal to said insulator outer diameter along a portion of said insulator body region.

4. The corona igniter of claim 1, wherein said insulator presents a thickness between said insulator inner surface and said insulator outer surface; and said thickness increases along a portion of said insulator between said intermediate firing end and said insulator nose end.

5. The corona igniter of claim 1, wherein said insulator has a length extending from said insulator upper end to said insulator nose end, and said intermediate part extends along not greater than one quarter of said length.

6. The corona igniter of claim 1, wherein said intermediate part is disposed adjacent said lower ledge.

7. The corona igniter of claim 1, wherein said insulator outer diameter tapers from said lower ledge along said insulator nose region to said insulator nose end.

8. The corona igniter of claim 1, wherein said intermediate part is disposed adjacent the shell firing end.

9. The corona igniter of claim 1, wherein the insulator outer diameter is less than said conductive inner diameter continuously from said insulator upper end to said lower ledge.

10. A method of forming a corona igniter, comprising the steps of:

providing an insulator formed of an electrically insulating material extending along a center axis from an insulator upper end to an insulator nose end, the insulator including an insulator outer surface extending from the insulator upper end to the insulator nose end and presenting an insulator outer diameter, the insulator outer surface presenting a lower ledge extending outwardly away from the center axis between an insulator body region and an insulator nose region;

disposing an intermediate part formed of an electrically conductive material between the insulator upper end and the lower ledge;

the step of disposing the intermediate part including applying a layer of metal to the insulator;

disposing a shell formed of an electrically conductive material around the insulator; and brazing the insulator to the shell with the layer of metal.

11. The method of claim 10, including the step of providing a melted metal material, and the step of applying the layer of metal to the insulator includes applying the melted metal material to the insulator and allowing the melted metal material to solidify.

12. The method of claim 10, wherein the step of disposing the shell around the insulator includes inserting the insulator nose end through a shell upper end.

13. The method of claim 10, wherein the intermediate part presents a conductive inner diameter, the insulator presents an insulator outer diameter, and the conductive inner diameter is less than the insulator outer diameter along a portion of the insulator between the lower ledge and the insulator nose end.

14. A corona igniter of claim 1, for emitting a radio frequency electric field to ionize a fuel-air mixture and provide a corona discharge, comprising:

a central electrode formed of an electrically conductive material for receiving a high radio frequency voltage and emitting the radio frequency electric field;

an insulator formed of an electrically insulating material surrounding said central electrode and extending longitudinally along a center axis from an insulator upper end to an insulator nose end;

said insulator including an insulator outer surface extending from said insulator upper end to said insulator nose end;

said insulator outer surface presenting an insulator outer diameter extending across and perpendicular to said center axis;

said insulator including an insulator body region and an insulator nose region;

said insulator outer surface including a lower ledge extending outwardly away from said center axis between said insulator body region and said insulator nose region;

said lower ledge presenting an increase in said insulator outer diameter;

a conductive component surrounding at least a portion of said insulator body region such that said insulator nose region extends outwardly of said conductive component;

said conductive component including a shell surrounding at least a portion of said insulator body region and extending from a shell upper end to a shell firing end;

said shell presenting a shell inner surface facing said center axis and extending along said insulator outer surface from said shell upper end to said shell firing end;

said conductive component including an intermediate part formed of an electrically conductive material and surrounding a portion of said insulator body region and extending longitudinally from an intermediate upper end to an intermediate firing end;

said intermediate part including an intermediate inner surface facing said center axis and extending longitudinally along said insulator outer surface from said intermediate upper end to said intermediate firing end;

said intermediate inner surface presenting a conductive inner diameter extending across and perpendicular to said center axis;

said conductive inner diameter being less than said insulator outer diameter along a portion of said insulator located between said lower ledge and said insulator nose end;

said intermediate part being disposed between said insulator upper end and said lower ledge;

said intermediate part being a layer of metal, and wherein said layer of metal contains at least one of nickel, cobalt, iron, copper, tin, zinc, silver, and gold.

15. A corona igniter for emitting a radio frequency electric field to ionize a fuel-air mixture and provide a corona discharge, comprising:

a central electrode formed of an electrically conductive material for receiving a high radio frequency voltage and emitting the radio frequency electric field;

an insulator formed of an electrically insulating material surrounding said central electrode and extending longitudinally along a center axis from an insulator upper end to an insulator nose end;

said insulator including an insulator outer surface extending from said insulator upper end to said insulator nose end;

said insulator outer surface presenting an insulator outer diameter extending across and perpendicular to said center axis;

said insulator including an insulator body region and an insulator nose region;

said insulator outer surface including a lower ledge extending outwardly away from said center axis between said insulator body region and said insulator nose region;

said lower ledge presenting an increase in said insulator outer diameter;

a conductive component surrounding at least a portion of said insulator body region such that said insulator nose region extends outwardly of said conductive component;

said conductive component including a shell surrounding at least a portion of said insulator body region and extending from a shell upper end to a shell firing end;

said shell presenting a shell inner surface facing said center axis and extending along said insulator outer surface from said shell upper end to said shell firing end;

said conductive component including an intermediate part formed of an electrically conductive material and surrounding a portion of said insulator body region and extending longitudinally from an intermediate upper end to an intermediate firing end;

said intermediate part including an intermediate inner surface facing said center axis and extending longitudinally along said insulator outer surface from said intermediate upper end to said intermediate firing end;

said intermediate inner surface presenting a conductive inner diameter extending across and perpendicular to said center axis;

said conductive inner diameter being less than said insulator outer diameter along a portion of said insulator located between said lower ledge and said insulator nose end;

said intermediate part being disposed between said insulator upper end and said lower ledge;

said intermediate part being a layer of metal, and wherein said intermediate part further includes a solid ring brazed to the insulator and the shell by the layer of metal.

16. A method of forming a corona igniter, comprising the steps of:

providing an insulator formed of an electrically insulating material extending along a center axis from an insulator upper end to an insulator nose end, the insulator including an insulator outer surface extending from the insulator upper end to the insulator nose end and presenting an insulator outer diameter, the insulator outer surface presenting a lower ledge extending outwardly away from the center axis between an insulator body region and an insulator nose region;

disposing an intermediate part formed of an electrically conductive material between the insulator upper end and the lower ledge;

the step of disposing the intermediate part including applying a layer of metal to the insulator;

disposing a shell formed of an electrically conductive material around the insulator; and wherein the layer of metal contains at least one of nickel, cobalt, iron, copper, tin, zinc, silver, and gold.

17. A method of forming a corona igniter, comprising the steps of:

providing an insulator formed of an electrically insulating material extending along a center axis from an insulator upper end to an insulator nose end, the insulator including an insulator outer surface extending from the insulator upper end to the insulator nose end and presenting an insulator outer diameter, the insulator outer surface presenting a lower ledge extending outwardly away from the center axis between an insulator body region and an insulator nose region;

disposing an intermediate part formed of an electrically conductive material between the insulator upper end and the lower ledge;

the step of disposing the intermediate part including applying a layer of metal to the insulator;

disposing a shell formed of an electrically conductive material around the insulator; and wherein the layer of metal is applied before disposing the shell around the insulator, and including disposing the shell around the intermediate part.

18. A method of forming a corona igniter, comprising the steps of:

providing an insulator formed of an electrically insulating material extending along a center axis from an insulator upper end to an insulator nose end, the insulator including an insulator outer surface extending from the insulator upper end to the insulator nose end and presenting an insulator outer diameter, the insulator outer surface presenting a lower ledge extending outwardly away from the center axis between an insulator body region and an insulator nose region;

disposing an intermediate part formed of an electrically conductive material between the insulator upper end and the lower ledge;

the step of disposing the intermediate part including applying a layer of metal to the insulator;

disposing a shell formed of an electrically conductive material around the insulator; and wherein step of the step of disposing the intermediate part between the insulator and shell includes brazing a solid ring to the insulator and the shell using the layer of metal.

* * * * *